US005170688A

United States Patent [19]

Keech et al.

[11] Patent Number: 5,170,688

[45] Date of Patent: Dec. 15, 1992

[54] ADJUSTABLE TRIPLE WALL FOLD APPARATUS AND METHOD

[75] Inventors: Roderick G. Keech, Louisville, Ky.; John W. Flynn, Dover Plains, N.Y.

[73] Assignee: Wayerhaeuser Company, Tacoma, Wash.

[21] Appl. No.: 714,208

[22] Filed: Jun. 12, 1991

Related U.S. Application Data

[63] Continuation-in-part of Ser. No. 476,525, Feb. 7, 1990.

[51] Int. Cl.[5] ..... B26D 3/06

[52] U.S. Cl. ..... 83/499; 83/863; 83/875; 83/887; 493/342; 493/365; 493/403

[58] Field of Search ..... 493/342, 365, 402, 403, 493/475; 83/862, 863, 875, 880, 881, 886, 887, 332, 344, 499

[56] References Cited

U.S. PATENT DOCUMENTS

| | | | |
|---|---|---|---|
| 2,048,684 | 7/1936 | Carr | 493/365 |
| 2,102,170 | 12/1937 | Stern | 493/365 |
| 2,759,523 | 8/1956 | Goldstein et al. . | |
| 3,096,224 | 7/1963 | Goldstein . | |
| 3,122,976 | 3/1964 | Anderson . | |
| 4,592,259 | 6/1986 | Gorner | 83/499 |
| 4,627,214 | 12/1986 | Anderson | 83/499 |

*Primary Examiner*—Bruce M. Kisliuk
*Assistant Examiner*—Jack Lavinder
*Attorney, Agent, or Firm*—Notary & Michalos

[57] ABSTRACT

An apparatus and method for forming a fold construction in a triple wall corrugated paper board comprises a pair of spaced a part main frame plates having four support plates connected therebetween in a direction which is transverse to a feed direction for the paper board. A pair of shaft carrier plates which have linear bearings thereon, are mounted for sliding movement to the support shafts between the frame plates. Spreader tubes are engaged around the support shafts for maintaining a selected and accurate distance between the carrier plates. Upper and lower shafts are rotatably mounted between the carrier plates and carry knives, scoring members or other fold forming elements for scoring or cutting the paper board to form segments of the fold construction. A table is fixed between the carrier plates that cooperates with a hold down roller which is rotatably mounted between the plates, to hold the paper board down and prevent curling or warping as the fold construction is formed.

17 Claims, 3 Drawing Sheets

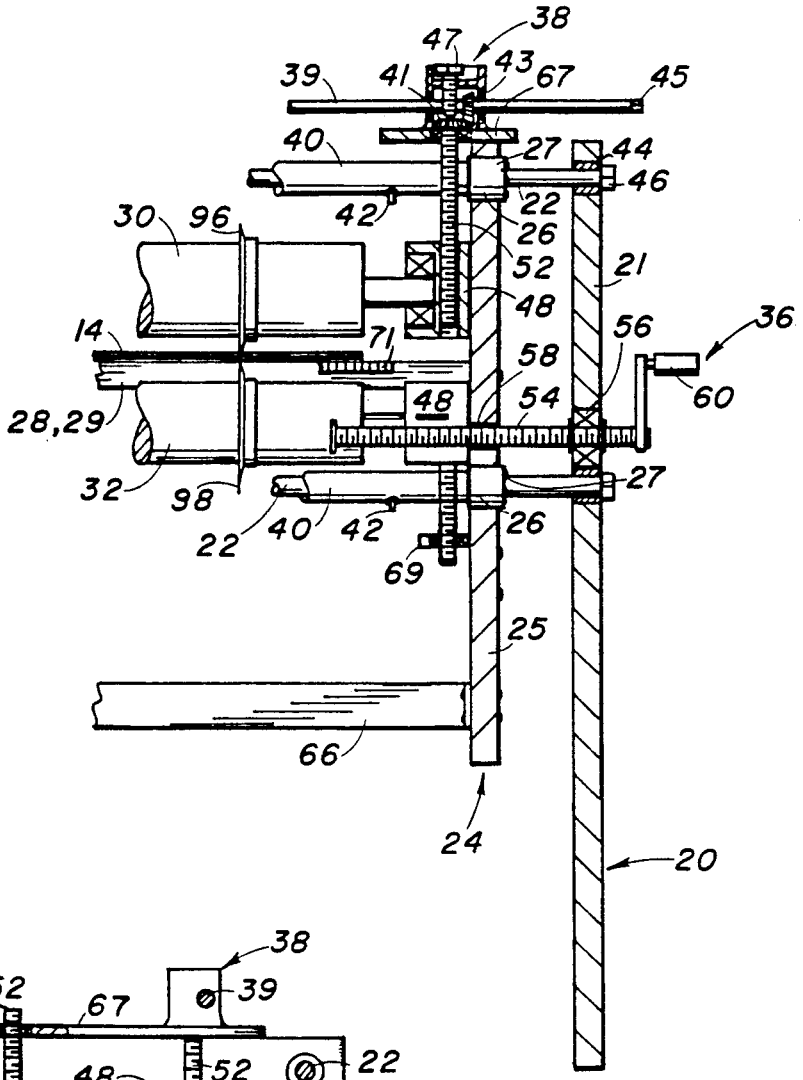
FIG. 3
FIG. 4
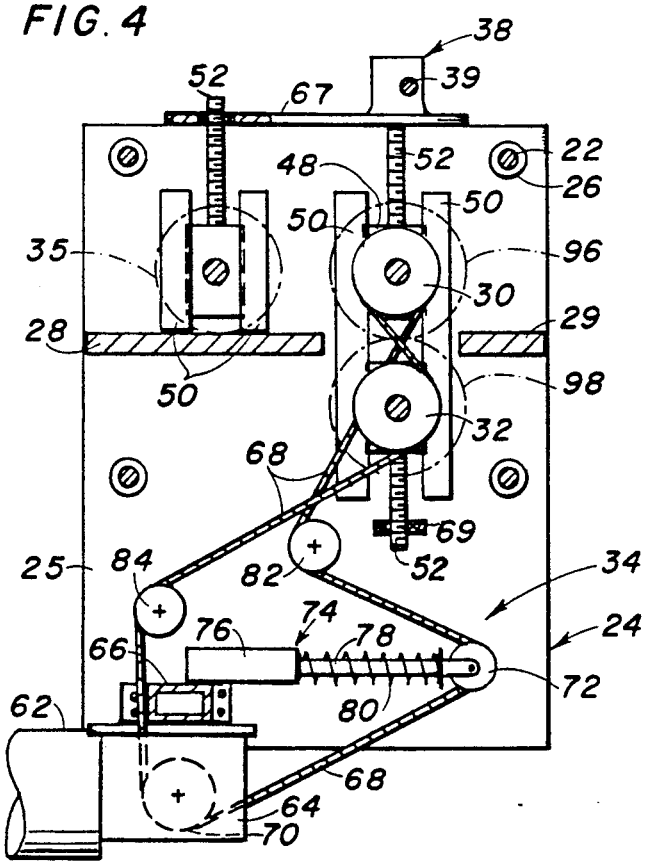

ADJUSTABLE TRIPLE WALL FOLD APPARATUS AND METHOD

CROSS REFERENCE TO RELATED APPLICATION

This is a continuation-in-part of Ser. No. 07/476,525 filed Feb. 7, 1990 entitled IMPROVED TRIPLE WALL FOLD CONSTRUCTION AND FOLDING PROCESS AND MECHANISM, which is incorporated here by reference, and which is now pending.

FIELD AND BACKGROUND OF THE INVENTION

The present invention relates in general to equipment and techniques for processing corrugated paper board, and in particular to a new and useful apparatus and method of forming a flap fold construction in triple wall corrugated paper board.

Triple wall corrugated paper board is a lamination of four paper liners and three corrugated paper mediums each of the mediums being interposed between two liners in each instance. The liners and mediums are intimately and rigidly secured to each other by adhesive applied to the ridges of the corrugations of the mediums.

The corrugations of the mediums are parallel to each other throughout the board. Three types of corrugations are typically used in triple wall construction, namely, types A, B and C. "A" flute is, for example, approximately 3/16 of an inch (4.7625 mm) high with, for example, 33.8 flutes of corrugations per linear foot (1.181 flutes of the corrugations per linear cm). "B" flute is, for example, approximately ⅛ of an inch (3.175 mm) high with, for example, 50 flutes of the corrugations per linear foot (1.6406) flutes of the corrugations per linear cm). "C" flute is, for example, about 5/32 of an inch (3.9688 mm) high with, for example, 42 flutes of the corrugations per linear foot (1.378 flutes of the corrugations per linear cm).

Various grades of paper board of different weight and characteristics are used for forming the corrugated medium and liner. Consequently, triple wall corrugated paper board is relatively thick and rigid. For example, triple wall corrugated paper board formed of A—A—A fluting is about ⅝ of an inch (15.875 mm) thick and, if made of A—A—C fluting, is about 9/16 of an inch (14.288 mm) thick.

Triple wall corrugated paper board has superb rigidity and strength, which compares favorably to wood as a packaging material. Yet, it is lightweight, foldable and has cushioning qualities that cannot be approached by wood. The strength, rigidity and cushioning properties of triple wall corrugated paper board makes it particularly useful and versatile in packaging a variety of articles of large volumes that may be heavy or fragile, or both. For example, cartons made of triple wall corrugated paper board are used for containing heavy materials such as industrial machinery or large appliances, smaller heavier materials such as machine parts, materials that are shiftable in transit such as bulk flowables, bulky agricultural products such as large loads of melons, and fragile items that may not necessarily be heavy as well, such as electronic equipment.

Triple wall corrugated paper board has been successfully manufactured for many years in accordance with the general techniques described in U.S. Pat. Nos. 2,759,523 and 3,290,205.

Foldable cartons composed of triple wall corrugated paper board are originally made from flat blanks that are scored and slotted to define the side panels and end flaps of the cartons. When such a carton is assembled, the panels and end flaps are folded along the score lines. Because of the rigidity and thickness of the triple wall corrugated paper board, resistance is often experienced in folding the flaps, especially in the case of cartons having narrow flaps. One expedient employed to reduce this difficulty has been the formation of a broad score line to crush the flap in the bending zone, and thereby, to minimize bending resistance. This solution is not entirely satisfactory, however, because the bending line is not clearly defined and the flap may tend to bend unevenly and unpredictably.

Another solution proposed for minimizing the resistance to binding of the flap, described in U.S. Pat. No. 3,122,976, is the provision of a blank with a crush-relieved zone contiguous to the score lines for the flaps. Nevertheless, when such a bend is made in triple wall corrugated paper board, a substantial amount of paper is compressed into the corner of the bend. This may cause the flap adjacent to the bend to bow slightly and prevent the flap from resting on a plane surface. The resulting carton, therefore, may rock. In addition, large forces may be required to bend the flap.

One solution, particularly for extra-long folds such as those needed for folding the panels in long-tubular containers, has been to cut a V-shaped groove into the board only through two of the corrugated mediums and two liners leaving the third "wall" composed of a corrugated medium and two liners, unaltered so that sufficient material remains to preserve the integrity of the board. On the other hand, sufficient material is removed by the cutter so that the remaining paper, when compressed into the score does not cause the flap to bow and the flap remains flat. The force required to bend the board is considerately reduced. Great care must be exercised, however, in order to precisely remove the adhesively—bonded liners and fluting without damage to the remaining material.

An alternative solution has been the formation of triple wall corrugated paper board sheet having single wall flaps. In this construction, two single face webs of the triple wall lamination have a shorter width than the third single face web and fourth liner. The small band along the edge of the shorter intermediate single face web is not glued to the underlying longer liner of the single face web bonded to the fourth liner. The edge is scored, slit and trimmed. A single wall flap is thereby formed. The single wall flap is easily foldable. A number of difficulties, however, have been experienced. In the formation process, in the heating section of the corrugated paper board machine, it is difficult to secure proper adhesion along the single wall flap due to the differences in the thickness relative to the remainder of the board. In addition, the resulting board is difficult to fabricate into boxes, the board stacks unevenly and is more difficult to print and the single wall flaps are not as sturdy as triple wall flaps.

SUMMARY OF THE INVENTION

A unique flap fold construction and mechanism to form the construction has been disclosed in the parent application identified above, to which this is a continuation-in-part application. The present application discloses an apparatus and method which is capable of quick and accurate adjustment to produce the unique flap fold construction in a variety of configurations and positions. The depth of cutting or scoring, as well as the transverse position of the cuts or scores can be precisely located by a single operator working on one side of the apparatus. The apparatus of the invention also includes a crosswalk which extends over the top of a triple wall product being processed to provide an operator with easy access to knives, score wheels and ploughs which are used to form one or more fold constructions in the product.

The apparatus and method of the present invention have several advantages. These include a reduction in waste product, reduced down-time for the apparatus, a reduction in time lost by the operator in adjusting the apparatus, an increase in overall production capacity by reducing the need for re-slitting of stored non-standard product to size, a reduction in set-up time needed for an operator to set locations for glue application and ploughs, a reduction in time and cost for repairs and maintenance, and an improved monitoring and planning capabilities for the operator.

The operator's job is more complex than merely setting knives, scorers and plough positions using appropriate wrenches and a tape measure. The operator must also foresee the adjustments which will be needed for several production orders which must be filled in sequence on the apparatus. The operator must try and avoid complications that may arise in coordinating the various operations such as slitting, scoring, cutting, gluing, waxing and printing on the product. Although waxing of the product using liquid wax to render the product moisture and/or water resistant, and printing on the product using ink-print wheels, goes beyond the scope of this disclosure, these additional steps must be considered by the operator utilizing the apparatus and method of the present invention.

Briefly stated, the invention comprises an apparatus for forming a fold construction in a triple wall corrugated paper board moving in a feed direction, which includes a main frame having at least one support shaft thereon extending in a transverse direction to the feed direction, a shaft carrier frame, linear bearing means connected between the shaft carrier frame and the support shaft for sliding movement of the shaft frame on the support shaft in the transverse direction, a table connected to the shaft frame for supporting a paper board as it moves in the feed direction, an upper fold construction shaft mounted for rotation to the shaft frame above the table, a lower fold construction shaft mounted for rotation to the shaft frame below the table and adjacent the upper shaft, and drive means connected to the upper and lower shafts for counter-rotation of the upper and lower shafts with respect to each other. At least one fold forming element is connected to the upper shaft for forming a fold segment extending in the feed direction on a paper board as it moves in the feed direction. This element is positioned at a selected transverse location on the upper shaft. Transverse positioning means are also connected between the main frame and the shaft frame for adjusting the transverse location of the fold forming elements by relative movement between the main frame and the shaft frame. Vertical positioning means are connected between the shaft frame and the upper shaft for adjusting the vertical position of the fold forming element connected to the upper shaft.

Another feature of the invention is the use of a hold-down roll mounted for rotation to the shaft frame above the table for holding a paper board moving in the feed direction down on the table to prevent its bending as fold segments are formed in the fold construction. According to another feature of the invention, the shaft frame comprises a pair of spaced apart shaft carrier plates, with a plurality of support shafts connected to the main frame for supporting the shaft plates. A spreader tube is engaged around each support shaft between the plates to maintain a fixed spacing between the plates. The linear bearing means are in the form of linear bearings engaged between the support shafts and their respective spreader tubes. By using four support shafts, the linear bearings of one shaft can be easily replaced while the shaft frame is supported on the other three support shafts.

Ease and accuracy in adjusting the vertical location of the upper fold construction shaft is also achieved by providing vertical positioning means on both shaft carrier plates which are linked to each other by a torque transmitting shaft or other mechanical connection. The transverse positioning means is also placed on an operator side of the apparatus so that most required adjustments can be made at the operator side by a single operator.

According to another advantageous feature of the invention, a crosswalk is positioned across the apparatus over the level of the table so that the operator has access to the various fold forming elements which must be positioned and adjusted on the shafts. This avoids requiring an operator to lean across the paper board which, in a preferred version of the invention, is 86 inches (218.44 cm) wide in the transverse direction.

The apparatus of the present invention is contemplated for use with apparatus disclosed in the parent application to this continuation-in-part application, for connecting the various layers together to form triple wall corrugated paper board. As one element of the former apparatus, a rubber scraper is used to remove adhesive from between two layers of material to facilitate the removal of a band of material that has been cut to a certain depth that is less than the full depth of the paper board, using a plough. According to the present invention, the operator of the present apparatus can use hand signals to indicate the location where adhesive is to be removed and quickly adjust the transverse location for cutting blades and the plough. The shaft carrier frame of the present invention is also provided with arms which carry a plough shaft which, in turn, supports the plough at a downstream location with respect to the upper and lower shafts. The crosswalk is advantageously located between the plough shaft and the upper shaft to provide the operator with maximum access to all parts of the apparatus which must be adjusted, maintained or repaired.

According to another feature of the invention, sensors are provided on the table to sense the transverse location of the edge of the paper board being processed. The sensor indicates so-called "weaving" which is a tendency of paper board to move sideways under the action of the fold forming element whether it is a cutting knife or a scoring member. The sensor may be connected to a display or directly connected to an automatic actuator which is, in turn, connected to the transverse positioning means for automatically bringing the paper board back to its desired transverse position.

The use of a transversely movable shaft carrier frame which also carries the plough shaft, is particularly advantageous because the operator can adjust the transverse location of the fold forming elements, to a range of 6 inch in a preferred form of the invention, and this adjustment is made simultaneously for cutting knives, scoring elements and the ploughs. Only when the knives or scoring elements are moved on the upper and lower shafts, must the operator also move the position of the ploughs along the plough shaft.

Accordingly an object of the present invention includes the provision of an apparatus and method which has the foregoing advantages and benefits. Another object of the present invention is to provide an apparatus for forming a fold construction in a triple wall corrugated paper board which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 3 is a partial elevational and sectional view of the operator side of the apparatus of FIG. 1; and FIG. 4 is a side elevational view showing the drive and vertical positioning mechanisms for the apparatus of the present invention.

DESCRIPTION OF THE PREFERRED EMBODIMENTS

Figure 1:
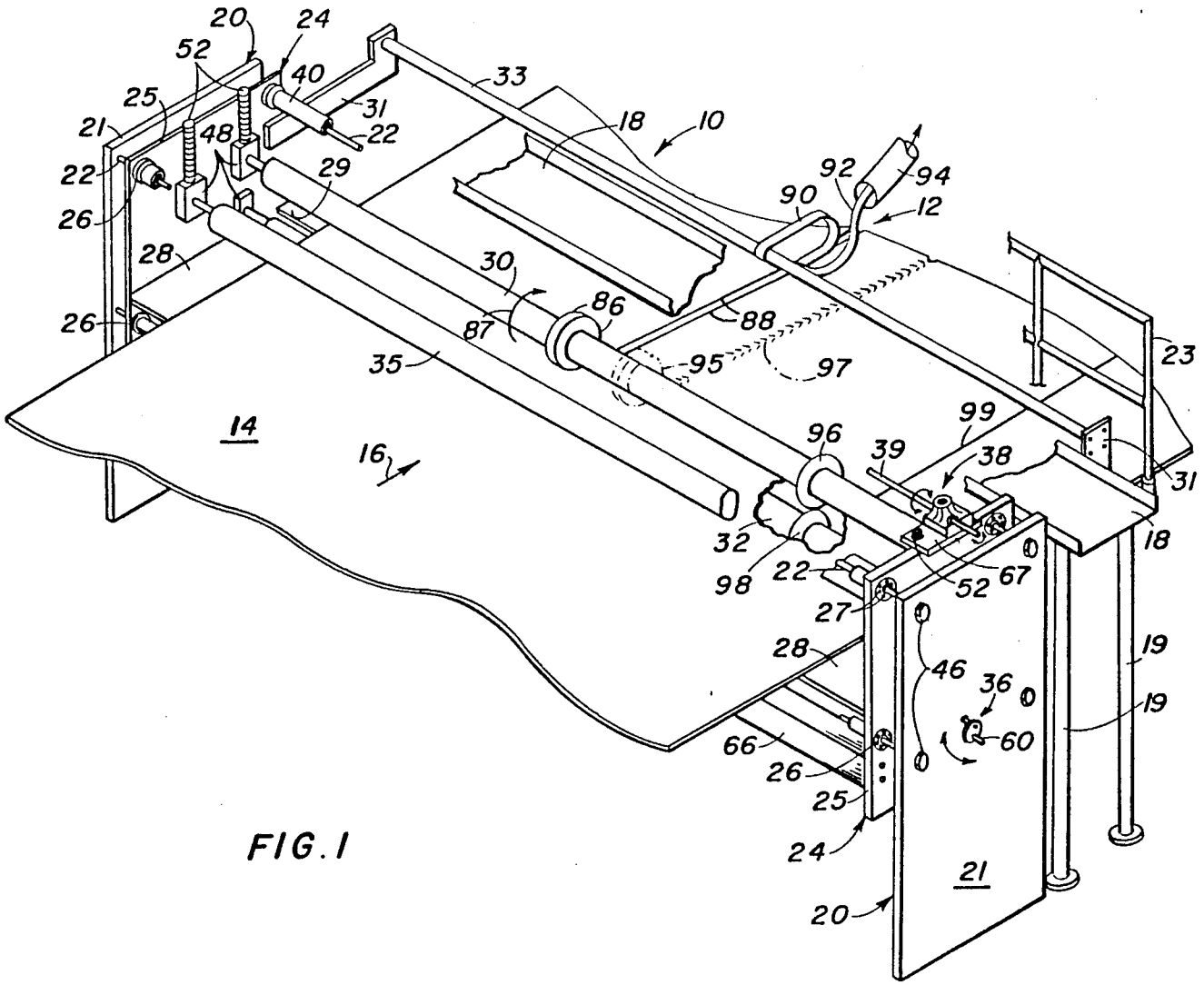
FIG. 1 is a top rear perspective view taken from the operator side of an apparatus constructed in accordance with the present invention, with some elements removed to reveal underlying structures.
Figure 2:
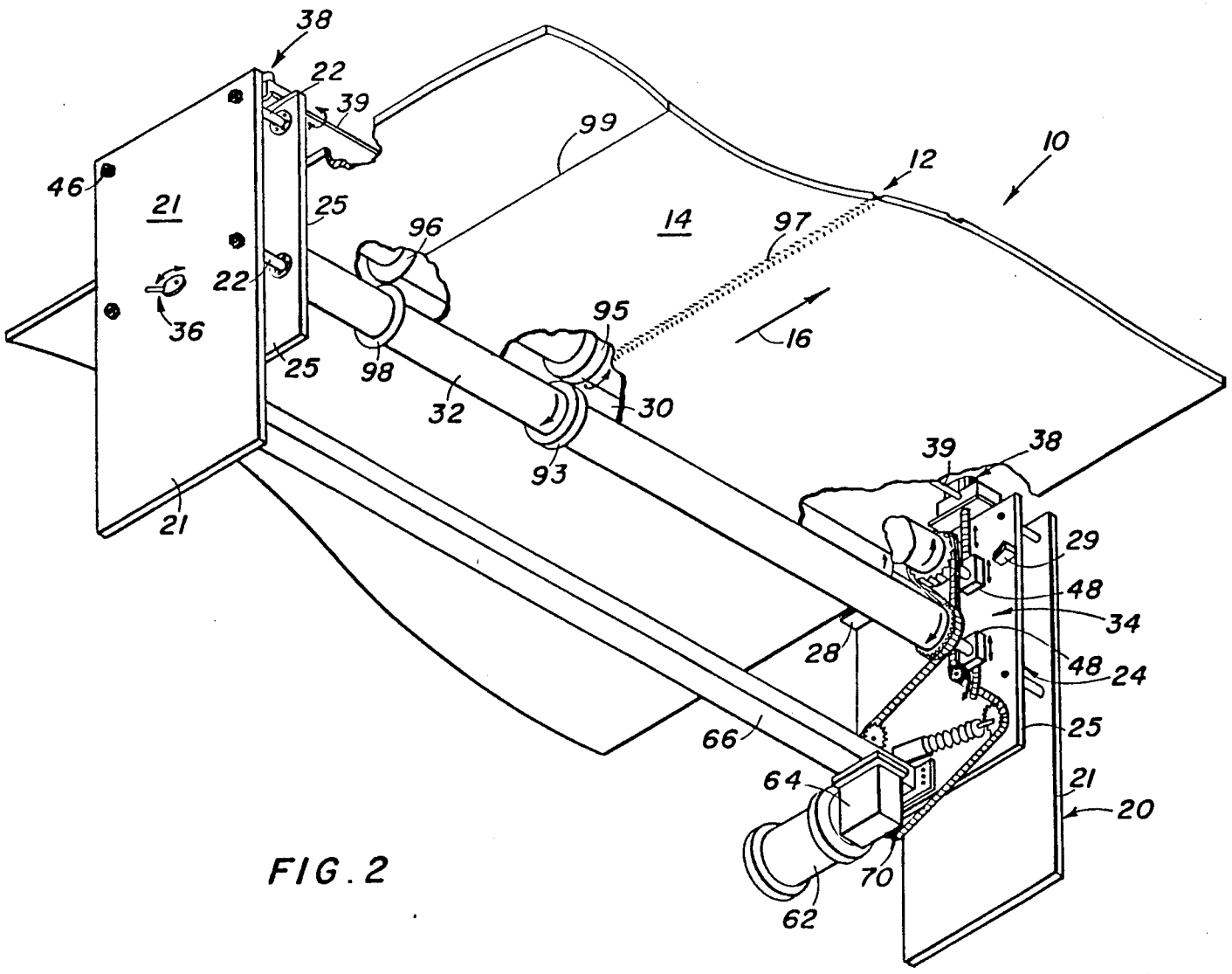
FIG. 2 is a bottom front perspective view of the apparatus of FIG. 1, also taken from the operator side, and again with elements removed for clarity.

Referring to the drawings in particular, the invention embodied in FIGS. 1 and 2 comprises an apparatus generally designated 10 for forming a fold construction generally designated 12 in a triple or multiwall corrugated paper board 14 which moves in a feed direction 16, through the apparatus.

Apparatus 10 comprises a main frame 20 which is mounted on the floor and which has four support shafts 22 extending transversely to the feed direction 16. A shaft carrier frame generally designated 24 is mounted for sliding movement on eight linear bearings 26, two mounted on each of the four support shafts 22. With two bearings on each shaft, shaft frame 24 can move transversely approximately 3 inches (7.62) in either direction, for a total stroke of 6 inches (15.24), between main frame plates 21 which form the sides of the main frame 20.

The paper board 14 is supported on a table having a rear portion 28 and a front portion 29. Table 28, 29 is fixed between support plates 25 which form the sides of shaft carrier frame 24. Four linear bearings 26 are mounted by six removable screws each to each shaft plate 25 at the four corners of a square. To maintain a precise spacing between plates 25, four spreader tubes 40 are positioned around the respective shafts 22 and between the pair of bearings 26 and plates 25 on each support shaft. As shown in FIG. 3, each spreader tube 40 has a lubrication fitting 42 which is used to fill the space between the shaft 22 and the spreader tube 40 with lubrication, to properly lubricate the linear bearings 26. The same fitting 42 can be used to drain the lubrication when the bearings must be replaced or repaired.

Each shaft 22 is made of smooth, hardened steel to provide a low friction and low wear sliding engagement with the bearings 26. The ends of each support shaft 22 is carried in a precision bushing 44, there being four bushings in each main plate 21.

By providing four shafts 22 with their associated bearings and spreader tubes, worn bearings can be changed in a quick and relatively simple procedure.

Referring to FIG. 3, when the bearings of one of the shafts 22 must be changed, the fitting 42 is utilized to drain lubrication from inside the spreader tube 40. Bolts 46 connecting the opposite ends of shaft 22, to the representative bushings 44 are then loosened to allow shaft 22 to be removed from the bearings 26 and from the carrier frame 24. Screws 27 connecting the bearings 26 to the opposite ends of the spreader tube 40 are then removed to disconnect the spreader tube. With the removal of shaft 22 and spreader tube 40, the remaining three support shafts 22 with their respective bearings and spreader tubes support the weight of the carrier frame 24. The bearings of the removed support shaft are then removed from the support plates 25 and are serviced or replaced along with the spreader tube and shaft. Serviced or replaced bearings, spreader tube and support shaft are then reinstalled and fitting 42 is used to fill the spreader tube with lubricating oil.

Upper and lower fold construction shafts 30 and 32 respectively, are rotatably mounted to bearings in take-up blocks 48 slidably mounted on vertically extending guides 50 connected to support plates 25 as shown in FIGS. 3 and 4. Each block 48 forms part of a vertical positioning mechanism 38 which includes a threaded shaft 52 having an outer end journaled to side plates 25, and an inner end which is threaded to an internally threaded bore in block 48. By rotating a threaded shaft 52 in a block 48, an end of the shaft 30 or 32 may be lifted or lowered. This sets the depth of cut or scoring for fold forming elements such as knives or scoring members which cut or score the surface of the paper board 14 to form fold segments of fold construction 12.

To set the transverse location of the fold forming elements on upper and lower shafts 30 and 32, horizontal positioning means 36 are provided. This is in the form of a threaded shaft 54 which is journalled at bearing 56 to the operator side support plate 21 shown in FIG. 3. Threaded shaft 54 is engaged into a threaded bore 58 provided in the operator side support plate 25. By rotating a handle 60, the operator can move the support frame 24 to the left or to the right in FIG. 3 for maximum stroke of approximately 6 inches in a preferred embodiment of the invention. By rotating handle 60, the shafts, plough and other elements connected to the support frame 24, as will be described later, move together, in the transverse direction to the feed direction 16.

Upper and lower shafts 30 and 32 are counter rotated in opposite respective directions by drive means generally designated 34 which are mounted to the support plate 25 on the machine side of the apparatus as best shown in FIGS. 2 and 4. Drive means 34 comprise a motor 62 which is fixed to a gear reduction box 64. Gear box 64 is mounted to the lower surface of a drive motor support bar 66 fixed between plates 25. Bar 66 further strengthens frame 24. A drive chain 68 is engaged over a sprocket 70 fixed to the output shaft of gear box 64. Chain 68 then engages around the sprocket 72 of a chain tensioning mechanism 74 comprising a sleeve 76 fixed to an inner surface of plate 25, a piston 78 slidably mounted into sleeve 76 and a spring 80 engaged between sleeve 76 and a fork carrying the sprocket 72, to bias the sprocket 72 outwardly or to the right as shown in FIG. 4. This maintains a constant tension on chain 68 and accommodates differences in the effective length of the drive path taken by the chain, as the upper and lower shafts 30, 32 are adjusted upwardly and downwardly by their respective vertical positioning mechanisms.

After engaging sprocket 72, chain 68 engages an idler sprocket 82 which is rotatably mounted to the inner surface of plate 25. The chain is then wrapped in a counter clockwise direction as viewed in FIG. 4, around a sprocket which is fixed to the drive end of shaft 30. The chain must then cross its earlier path and engage a sprocket fixed to the drive end of shaft 32. The chain then engages around a second idler sprocket 84 which is also rotatably mounted to the inner surface of plate 25, and then completes its path at sprocket 70. Since chain 68 is flexible, its path may easily move out of the plane of sprocket 82 and into the plane of sprocket 84 (which two sprockets are in slightly different planes) to allow for the "figure 8" configuration of the chain path at shafts 30, 32. This configuration causes the shafts 30 and 32 to rotate in opposite directions with respect to each other as the chain moves in one direction.

To form different fold construction segments, shafts 30 and 32 are rotated either in one direction or the other. For this reason, motor 62 and gear box 64 are reversible.

To form a trough in the upper surface of paper board 14, of the type disclosed in the parent to the present application, upper shaft 30 carries a pair of knives 86 which are spaced from each other as shown in FIG. 1. By rotating the threaded shafts 52 of the blocks 48 rotatably supporting the upper shaft 30, the upper shaft is moved to a selected depth of cut for the knives 86. This depth of cut can be adjusted to a very accurate extent which is within the thickness of one paper layer forming the paper board product 14. Upstream of the apparatus in FIG. 1, gluing equipment (not shown) is provided which includes a rubber scraper which is placed at the same transverse location as knives 86 to remove the glue from the area which will be just under the section of paper board 14 to be removed.

With knives 86 mounted to the shaft 30, shaft 30 is rotated in the direction of arrow 87. The knives thus move in an opposite direction to the feed direction 16 to make a pair of spaced cuts 88. Downstream of shaft 30, a plough 90 is engaged between cuts 88. This lifts a strip of material 92 from the upper surface of paper board 14. Strip 92 is waste and is drawn in a suction tube 94 to a waste storage location.

A knife 96 is also provided anywhere along the shaft 30. This knife operates in conjunction with knife 98 provided on lower shaft 32 for making a full cut 99 through the thickness of paper board 14, to trim the edge of the paper board. The paper board is normally trimmed one half to one and one half inches from its outer edge.

Additional knives may be provided on the drive side of the apparatus and more than one fold construction segment may be formed at one time by adding fold forming elements to the upper and lower shafts.

The apparatus of the present invention can also be utilized to construct a score line 97 in the surface of paper board 14, using a scoring member 95. This alternate embodiment of the invention is best shown in FIG. 2 where scoring member 95 on upper shaft 30 is shown counter rotating in cooperation with a scoring member 93 on the lower shaft 92. For scoring, the shafts are rotated in a direction opposite to that of arrow 87 in FIG. 1, so that the scoring members move in the same direction as the feed direction 16, to avoid ripping or damaging the paper surface of the paper board 14.

Knives and scoring members of the type used here are disclosed in U.S. Pat. No. 3,199,763.

In order to maintain an accurate horizontal position for the upper shaft 30, the vertical adjusting mechanisms 38 at both ends of the shaft are linked to each other by a torque shaft 39. As best shown in FIG. 3, the threaded shaft 52 on the block 48 rotatably supporting the shaft 30, has a bevel gear 41 fixed to its upper end which is meshed with a bevel gear 43 fixed on shaft 39. The threaded shafts 52 at both ends of upper shaft 30 can thus be rotated together by the same amounts by engaging a wrench to a square end 45 of the torque shaft 39, for rotating the torque shaft. Once the desired height is reached, a lock bolt 47 is screwed down on to the top of shaft 52 to maintain its position. The threaded shafts 52 of the lower shaft 32 are operated independently of each other. Alternately, a torque transmission mechanism similar to that applied to the upper shaft 30 can be used on the lower shaft as well.

Two additional blocks 48 rotatably support a hold-down roller 35 which rolls across the upper surface of paper board 14 and bears down on front table portion 28. Roller 35 has been found to maintain a flat unbent configuration for paper board 14. Without roller 35, the paper board tends to curl up as it comes under the influence of knives or scoring members on shafts 30 and 32. Blocks 48 rotatably carrying roller 35 may also be adjusted to a desired vertical height by rotating their threading shafts 52. For this purpose, a plate 67 (only one of which is shown in FIG. 1), is welded to the top of each support plate 25. The threaded shaft 52 for adjusting the height of roller 35 is journaled to plate 67 as is the shaft 52 carrying bevel gear 41. A similar plate 69 is welded to the inner surface of plate 25 as shown in FIG. 4, for journaling the lower end of the threaded shaft 52 which adjust the height of lower shaft 32.

The opposite edges of blocks 48 have a V or dovetail key configuration which engage with vertically extending and corresponding V or dovetail recesses in vertical guides 50. This confines the movement of the shafts 30 and 32 and roller 35, to the vertical components only. This, in conjunction with the four support shafts 22 and the precision linear bearings 26, maintains an accurate and reproducible vertical, horizontal and transverse position for the fold construction equipment on support frame 24.

To support plough 90, arms 31 are fixed to inner surfaces of plates 25, and extend in the feed direction 16. A plough shaft 33 is fixed between the downstream ends of arms 31. Plough 90, knives 86 or 96, and scoring members 95, 93 are of known construction and have bolts or screws which allow these elements to be positioned at any transverse location along their respective shafts. For this purpose, a crosswalk 18 supported on four legs 19 spans the full width of the apparatus and extends over the upper surface of paper board 14, between the upper shaft 30 and the plough shaft 33. To satisfy OSHA requirements, the crosswalk 18 is 18 inches (45.72 cm) wide and has a closed diamond-checkered plate construction. Vertically extending toeboards extend upwardly from opposite edges of the crosswalk 18 and a single hand rail 23 is also fixed to the legs 19 on one side of the crosswalk. Hinged sections (not shown) are provided in the hand rail and crosswalk 18 at spaced locations to provide better access to the machinery which must be adjusted on the apparatus of the invention.

The use of crosswalk 18 permits the operator to easily access all parts of the apparatus without having to lean over the paper board product which can be 86 inches wide.

Crosswalk 18 is also a convenient structure for carrying markings, scales and other indicators of transverse location to use in conjunction with the plough, knives and scoring members.

A degree of automatic operation can also be achieved by using edge sensors 71 (FIG. 3) provided for example in the upper surface of the rear table portion 29, near the edges of the paper board 14. Sensors 71 can be connected to automatic devices or displays (not shown) which may automatically indicate an unwanted transverse wandering of the paper board, or automatically compensate for that wandering.

While specific embodiments of the invention have been shown and described in detail to illustrate the application of the principles of the invention, it will be understood that the invention may be embodied otherwise without departing from such principles.

What is claimed is:

1. An apparatus for forming a fold line construction in a multiwall corrugated paper board moving- in a feed direction, comprising:

a main frame having at least one support shaft thereon extending in a transverse direction to the feed direction;

a shaft carrier frame;

linear bearing means connected between the shaft carrier frame and the support shaft for sliding movement of the shaft frame on the support shaft in the transverse direction;

an upper fold line construction shaft mounted for rotation to the shaft frame;

a lower fold line construction shaft mounted for rotation to the shaft frame below and adjacent to the upper shaft;

drive means connected to the upper and lower shafts for rotation of the upper and lower shafts with respect to each other;

at least one fold line forming element connected to the upper shaft for forming a fold line segment extending in the feed direction, on a paper board as it moves in the feed direction, at a selected transverse location along the transverse direction;

transverse positioning means connected between the main frame and the shaft frame, for adjusting the transverse location of the fold line forming element by relative movement between the main frame and the shaft frame; and vertical positioning means connected between the shaft frame and the upper shaft for adjusting the vertical position of the fold line forming element connected to the upper shaft.

2. An apparatus according to claim 1, including a table connected to said support frame and extending parallel to the feed direction, and a hold-down roller mounted for rotation to the support frame at an offset location from the upper shaft with respect to the feed direction, the roller being positioned to cooperate with the table for holding a paper board against the table to prevent the paper board from bending as the fold line forming element forms the fold line segment.

3. An apparatus according to claim 2, wherein the table comprises a front portion on one side of the upper and lower shafts and a rear portion on an opposite side of the upper and lower shafts, with respect to the feed direction.

4. An apparatus according to claim 3, wherein the shaft carrier frame comprises a pair of spaced apart shaft carrier plates, the main frame having a plurality of support shafts thereon all extending parallel to each other in the transverse direction and spaced from each other, each of the carrier plates having a plurality of holes therein equal in number to the number of support shafts with a linear bearing in each hole defining the linear bearing means, each support shaft being mounted for linear movement on a linear bearing in each carrier plate.

5. An apparatus according to claim 4, including a spreader tube engaged between the carrier plates and around each support shaft for maintaining a fixed distance between the carrier plates.

6. An apparatus according to claim 5, including a bar fixed between the carrier plates, the drive means being mounted to the bar.

7. An apparatus according to claim 1, including a plough shaft connected to and movable with the shaft carrier frame, a plough fixed at an adjustable transverse location to the plough shaft, the plough shaft being downstream of the upper shaft with respect to the feed direction.

8. An apparatus according to claim 7, including a crosswalk extending in a transverse direction above a plane containing a paper board moving in the feed direction, the crosswalk extending between the plough shaft and the upper shaft for providing an operator access in the transverse direction to the upper shaft and plough shaft.

9. An apparatus according to claim 7, wherein the shaft carrier frame comprises a pair of carrier plates which are spaced from each other in a transverse direction, a plough arm extending from each carrier plate in the feed direction, the plough shaft being fixed between the plough arms.

10. An apparatus according to claim 1, wherein the shaft carrier frame comprises a pair of carrier plates spaced from each other in the transverse direction, the transverse positioning means being engaged between the main frame and one of the carrier plates, the drive means being mounted to the other carrier plate.

11. An apparatus according to claim 10, wherein the drive means comprises a bar fixed between the carrier plates, motor means fixed to the bar, a first sprocket rotatably mounted to the motor means, a second sprocket fixed to the upper shaft near the other carrier plate, a third sprocket fixed to the lower shaft near the other carrier plate, a tension sprocket, tensioning means connected between the tension sprocket and the other carrier plate for accommodating a change in path length for a chain engaged around the sprockets, and a chain engaged around the sprockets, the chain engaging around the second sprocket in one rotational direction and around the third sprocket in an opposite rotational direction so that the upper and lower shafts are always counter rotated with respect to each other.

12. An apparatus according to claim 11, wherein the transverse positioning means comprises a threaded shaft journalled to the main frame and threaded to the one carrier plate so that rotation of the threaded shaft causes transverse movement of the shaft carrier frame.

13. An apparatus according to claim 1, wherein the main frame comprises a pair of frame plates spaced from each other in the transverse direction, a plurality of the support shafts being fixed between the frame plates and extending parallel to each other in the transverse direction, the shaft carrier frame comprising a pair of carrier plates each slidably mounted to each of the support shafts, a spreader tube between the carrier plates and around each support shaft, the vertical positioning means comprising a take-up block at each end of each of the upper and lower shafts for rotatably receiving the ends of the upper and lower shafts, each take-up block being mounted for vertical sliding movement to one of the carrier plates, and take-up means engaged between each block and its respective carrier plate for changing the vertical position of each block.

14. An apparatus according to claim 13, wherein each take-up means comprises a threaded shaft journalled to one of the carrier plates and threaded into a respective take-up block.

15. An apparatus according to claim 13, including torque transmission means engaged between the take-up means at the opposite ends of the upper shaft for simultaneously lifting and lowering the take-up block of the upper shaft for maintaining a horizontal position for the upper shaft.

16. An apparatus according to claim 13, including a plurality of vertical guides connected to each of the carrier plates, each of the take-up blocks being slidably mounted for vertical movement between a pair of guides.

17. An apparatus according to claim 16, including a table for carrying a paper board moving in the feed direction, the table including a front portion on one side of the upper and lower shafts and a rear portion on an opposite side of the upper and lower shafts, with respect to the feed direction, and a hold-down roller rotatably mounted between the carrier plates for cooperation with the front table portion to hold a paper board down on to the front table portion, the front and rear table portions being fixed between the carrier plates.

* * * * *

UNITED STATES PATENT AND TRADEMARK OFFICE

CERTIFICATE OF CORRECTION

PATENT NO. : 5,170,688

DATED : December 15, 1992

INVENTOR(S) : Roderick G. Keech, et al.

It is certified that error appears in the above-identified patent and that said Letters Patent is hereby corrected as shown below:

TITLE PAGE

Please correct the spelling of the Attorney, Agent, or Firm, to read -- Notaro & Michalos --.

Signed and Sealed this

Fourth Day of January, 1994

Bruce Lehman

*Attest:*

BRUCE LEHMAN

*Attesting Officer*

*Commissioner of Patents and Trademarks*